US005301758A

United States Patent [19]

Jenne

[11] Patent Number: 5,301,758

[45] Date of Patent: Apr. 12, 1994

[54] METHOD AND APPARATUS FOR ENLARGING A BORE HOLE

[75] Inventor: Dietmar Jenne, Wiesenweg, Switzerland

[73] Assignee: TERRA AG fuer Tiefbautechnik, Strengelback, Switzerland

[21] Appl. No.: 812,915

[22] Filed: Dec. 23, 1991

[30] Foreign Application Priority Data

Dec. 24, 1990 [CH] Switzerland ..... 04077/90

[51] Int. Cl.[5] ..... E21B 4/14; E21B 7/28

[52] U.S. Cl. ..... 175/21; 173/91; 175/19; 175/53; 175/62; 175/296

[58] Field of Search ..... 175/53, 19, 21, 92, 175/62, 296, 100; 173/80, 91

[56] References Cited

U.S. PATENT DOCUMENTS

| | | | |
|---|---|---|---|
| 1,005,770 | 10/1911 | Clark | 175/21 X |
| 2,740,612 | 4/1956 | Phipps | 175/393 |
| 3,151,687 | 10/1964 | Sato et al. | 173/91 X |
| 3,905,431 | 9/1975 | Hasewend | 175/53 |
| 4,249,620 | 2/1981 | Schmidt | 175/53 |
| 4,671,703 | 6/1987 | Schmidt | 175/62 X |
| 4,749,050 | 6/1988 | Ritter | 175/21 X |
| 5,096,000 | 3/1992 | Hesse | 175/296 X |

FOREIGN PATENT DOCUMENTS

| | | | |
|---|---|---|---|
| 545726 | 3/1977 | U.S.S.R. | 175/21 |

*Primary Examiner*—Hoang C. Dang
*Attorney, Agent, or Firm*—John R. Benefiel

[57] ABSTRACT

A method and apparatus for enlarging a straight or arcuate pilot bore hole and the insertion of tubing in the enlarged bore is disclosed, in which the pilot bore hole 10 is enlarged by advancing a larger diameter housing with a conical enlarging head by impacting of a striking body mounted within a housing against the inside of the enlarging head at the forward end of the housing. Fluid jet cutting action is also employed and the pilot hole boring device may be coupled to exert a steady pull on the housing as it is advanced through the pilot bore. The housing may thus be connected to the pilot bore drilling device, with an interposed cushioning device. The fluid jets may be created by nozzle openings in the enlarging head or in a separate device mounted forward of the enlarging head.

16 Claims, 10 Drawing Sheets

METHOD AND APPARATUS FOR ENLARGING A BORE HOLE

BACKGROUND OF THE INVENTION

This invention concerns a method for enlarging a bore hole, either straight or arcuate.

A prior art device is disclosed in U.S. Pat. No. 4,674,479 for enlarging an existing pilot bore hole in the ground, in which the pointed end of a conical enlarging head is fitted to a tubular member that has been installed in a pilot bore hole and is drawn by the same through the pilot bore hole During this process, fluid is supplied to the enlarging head, forced under high pressure through the tubing. The enlarging head has a plurality of passages which extend longitudinally, substantially in the direction of movement, as well as transversely thereto, and which are in fluid communication with the inner bore of the tubular member. Injection nozzles located at the outer ends of the passages are provided for producing a fine liquid high-pressure jet which is used to cut through the ground.

Due to the pull exerted on the tubing and the rotating motion of the tubing, the cone-shaped enlarging head is steadily pulled while being forced, rotatingly into the earth mass split by the fluid jet, whereby the pilot hole is enlarged.

Thus, the hole enlarging procedure is comprised of a rotational movement and a steady axial thrust of the enlarging head into the earth mass surrounding the pilot hole. During this hole enlarging procedure the associated tubing is also being pulled through the bore hole.

The disadvantage of this prior art procedure is that difficulties will arise when working in ground that is relatively solid, or in ground with rock inclusions. While it is still possible to drill the pilot hole in this type of soil, because the pilot hole drilling device is able to laterally bypass the rock inclusions, difficulties are encountered during the hole enlargement process because the rock inclusions must be either displaced in the solid soil, or parts of the rock inclusions must be separated. This cannot be accomplished with the prior art device described above.

In densely compacted ground, even ground without rock inclusions, the enlarging procedure of the pilot hole in the ground often times cannot be carried out only by flushing or cutting and with the application of static traction forces, because the enlarging head diameter is approximately 3 to 4 times the size of the pilot hole diameter. As a result, the cross-sectional area of the pilot bore is enlarged by 9 to 16 times to the cross section of the enlarged bore, and the peripheral wall is being enlarged accordingly. When applying purely static traction forces and pressures there is also the risk that the large frictional forces acting on the peripheral wall of the tubing can no longer be overcome because of the surrounding soil masses.

Therefore, it is the object of the present invention to provide a method and apparatus for enlarging bore holes in solid soil masses or soils with rock inclusions which eliminates the disadvantages described above.

SUMMARY OF THE INVENTION

This object is accomplished by combining a cutting action with a ramming action produced by a cyclically operated striking means causing impacting of the inside of an enlarging head attached to the front of a cylindrical housing with a striking body by pneumatic ram means included in the bore hole enlarging apparatus. The bore hole enlarging apparatus may be coupled to the pilot hole forming rod to have a steady pull exerted on the enlarging apparatus in addition to the striking means and the cutting action.

In this case, high pressure fluid may be supplied via an internal passage in the rod to supply fluid jet cutting nozzle openings either in the enlarging head or a separate unit coupled to the enlarging head. Lubrication outlet openings may also be similarly supplied.

A damping unit is employed to cushion the forces applied by the striking means when the enlarging head is coupled to pilot hole drill.

Various bore hole enlarging cylindrical housing shapes may be employed, such as a waist shape or reduced end diameter for use in enlarging arcuate pilot bore holes.

The rear of the housing is adapted to receive tubing sections to be pulled into the enlarged bore hole.

Other details and advantages of the present invention will become apparent from the following description of exemplary embodiments taken in conjunction with the accompanying drawings.

DETAILED DESCRIPTION

Figure 1:
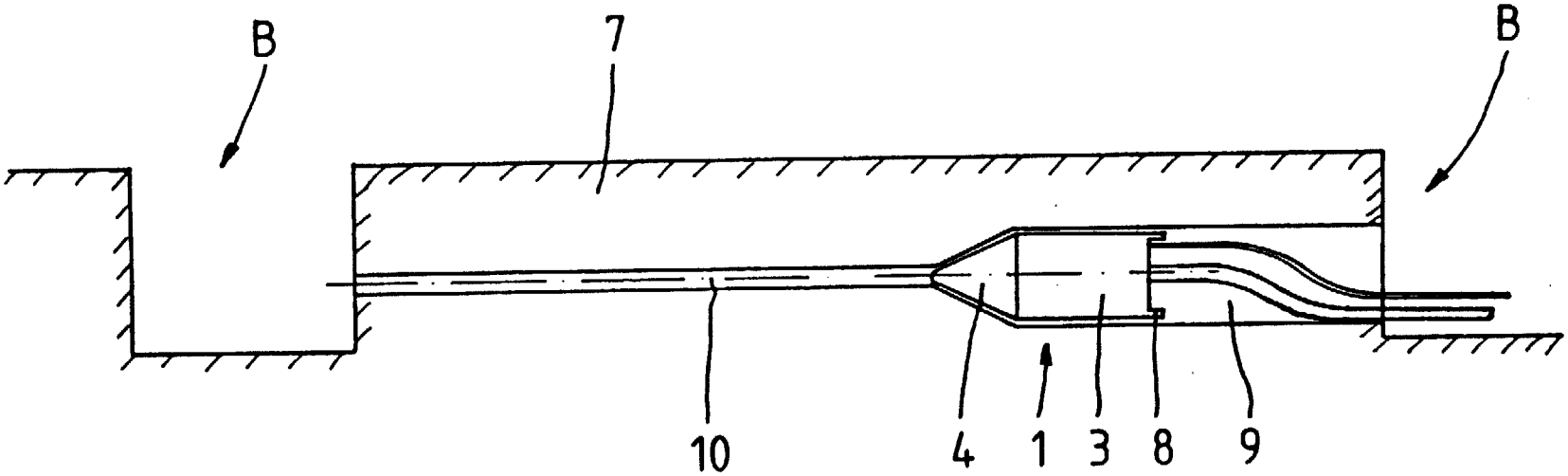
FIG. 1 is a sectional view through a site showing a pilot hole and apparatus according to the invention installed to enlarge the pilot hole.

A pilot bore hole 10 extending through an earth mass at a site between two excavations B is shown in FIG. 1 in the process of being enlarged by a hole enlarging apparatus 1 driven into the pilot hole 10 from one side of the pilot hole 10.

Figure 2:
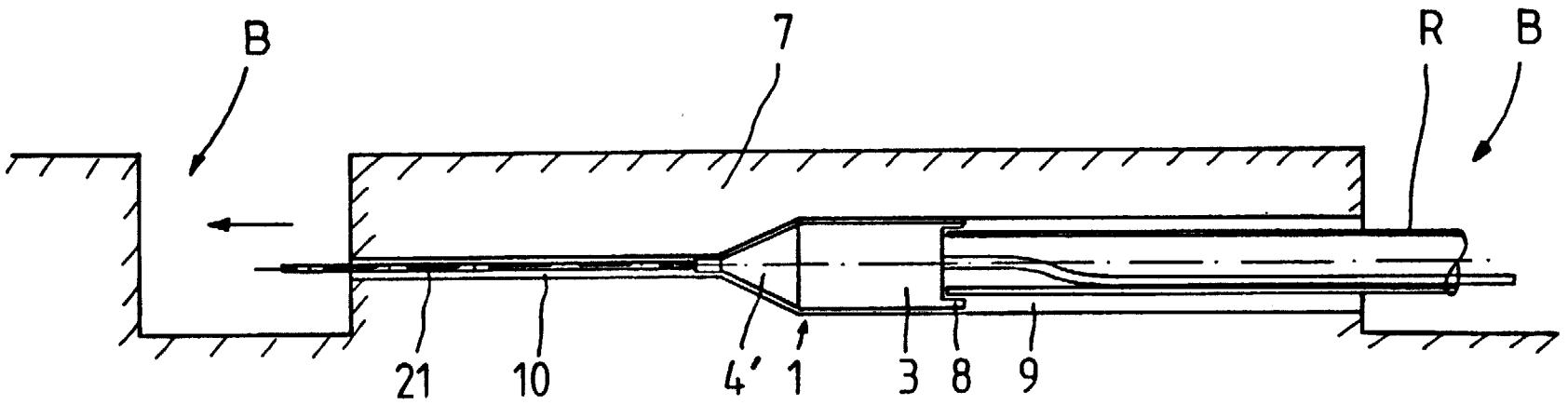
FIG. 2 is a sectional view through a site showing a pilot hole which is to be enlarged and a rod boring device which formed the pilot hole with the pilot hole, enlarging apparatus coupled to the rod boring device.

In accordance with a variation of the method according to the invention, the enlarged hole 9 may be created in a step following immediately the pilot hole boring operation as shown in FIG. 2. In this variation of the method, the device for boring the pilot hole 10, as for instance a tubular boring rod 2; equipped with a displacement head, has connected thereto a hole enlargement device 1 (FIG. 2). By drawing the pilot hole boring rod 21 from the pilot hole, the hole enlarging apparatus is guided in the pilot hole 10.

A static pull of about 5 tons may be supplied to the hole enlarging apparatus 1 which is coupled to the pilot hole boring rod 21 and which is preferably equipped with a damping unit described below. The hole enlarging apparatus 1 creates both a cutting and ramming action to effect an enlargement of the pilot bore 10. A pilot hole 10 of this type may have a diameter as large as 40 to 50 mm, and the enlarged hole a diameter of 160 to 200 mm. The operation of supplying the hole enlarging apparatus 1 with cutting solution can also be achieved by a passage in the pilot hole boring rod 21.

One characteristic common to both variations of the method according to the present invention, is that the enlargement of the pilot hole 10 is accomplished by subjecting the pilot bore 10 to both a percussion or ramming and a cutting action, as well as by, a steady displacement of the earth mass 7 by advancing a housing through the pilot hole 10. The cutting is preferably accomplished by high-pressure cutting fluid.

This method enables part of the cutting fluid supplied for cutting into the ground to be used as a lubricant for reducing the friction between the wall of the hole and the tubing that is pulled in.

In the course of this cutting operation, cutting solution is jetted out in a conventional manner through nozzles and directed under high-pressure into the ground surrounding the pilot hole so as to split up the ground and to thereby facilitate the hole drilling and enlarging operation.

The apparatus 1 for implementing this method, incorporates a ramming action provided by striking means 2 (FIG. 3)advancing a cylindrical housing 3 having a forwardly located generally conical enlarging head 4. A striking piston 2.1 having a flattened conical end 5 is including in the striking means 2, adapted for impacting the matching flat end face side of the inside of the front of the enlarging head 4. The cylindrical length of the housing wall of the striking means 2 is one fourth of the housing diameter.

As stated, the striking means 2 includes a striking piston 2.1 with a hollow cylindrical rearward portion, the striking piston 2.1 being adapted for reciprocating movement inside the cylindrical housing 3. The striking piston 2.1 is actuated by pressurized air and is provided at its rearward end with control ports 2.2, and its reciprocating movement is effected by a control valving member 6 constituted by leading edges 6.1 which extend partially inside the strikinq piston 2.1 and which cooperate with control ports 2.2 disposed in the striking piston 2.1 to create a cyclical pressurization. The arrangement being such that the striking piston 2.1 is thus caused to cyclically impact the inside of the enlarging head 4 so as to cause advancing movement of the apparatus in the ground mass 7.

On the rearward end of the housing 3 there is arranged an annular projection 8 for coupling successive tubular sections and for insertion of the same into the enlarged hole 9.

The housing 3 is closed at its rearward end with a cap 3.7 which is provided with venting openings 3.8 and which serves as a means to accommodate the control valving member 6 as well as the conduits for a a fluid supply. The annular projection 8 extends to the rear of the housing 3 and has an inside diameter sized to receive sections of tubing R to be drawn into the enlarged bore 9.

In accordance with a first embodiment of the apparatus according to the invention, supply conduits are provided in the housing wall connected to a first supply line 11 for receiving cutting fluid which is directed to a cutting device 13. The fluid supply system directs cutting fluid to the cutting device 13 received from a source outside the bore hole 10. An outside source also supplies pressurized air for operation of the striking means 2. A second supply line 12 is provided which is adapted for connection to the valve outside source.

Figure 4:
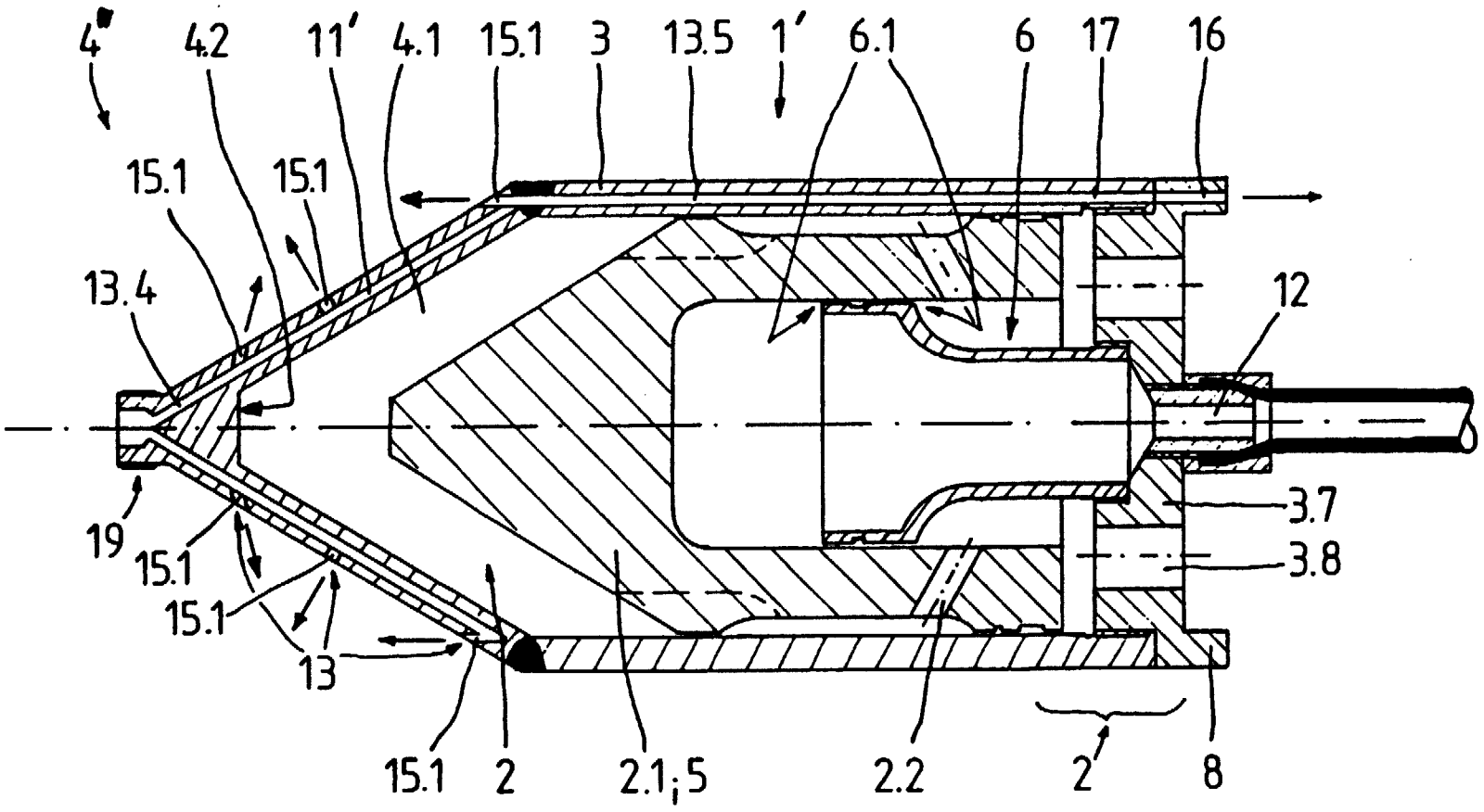
FIG. 4 is a longitudinal sectional view through the pilot hole enlarging apparatus according to a second embodiment of the invention.
Figure 5:
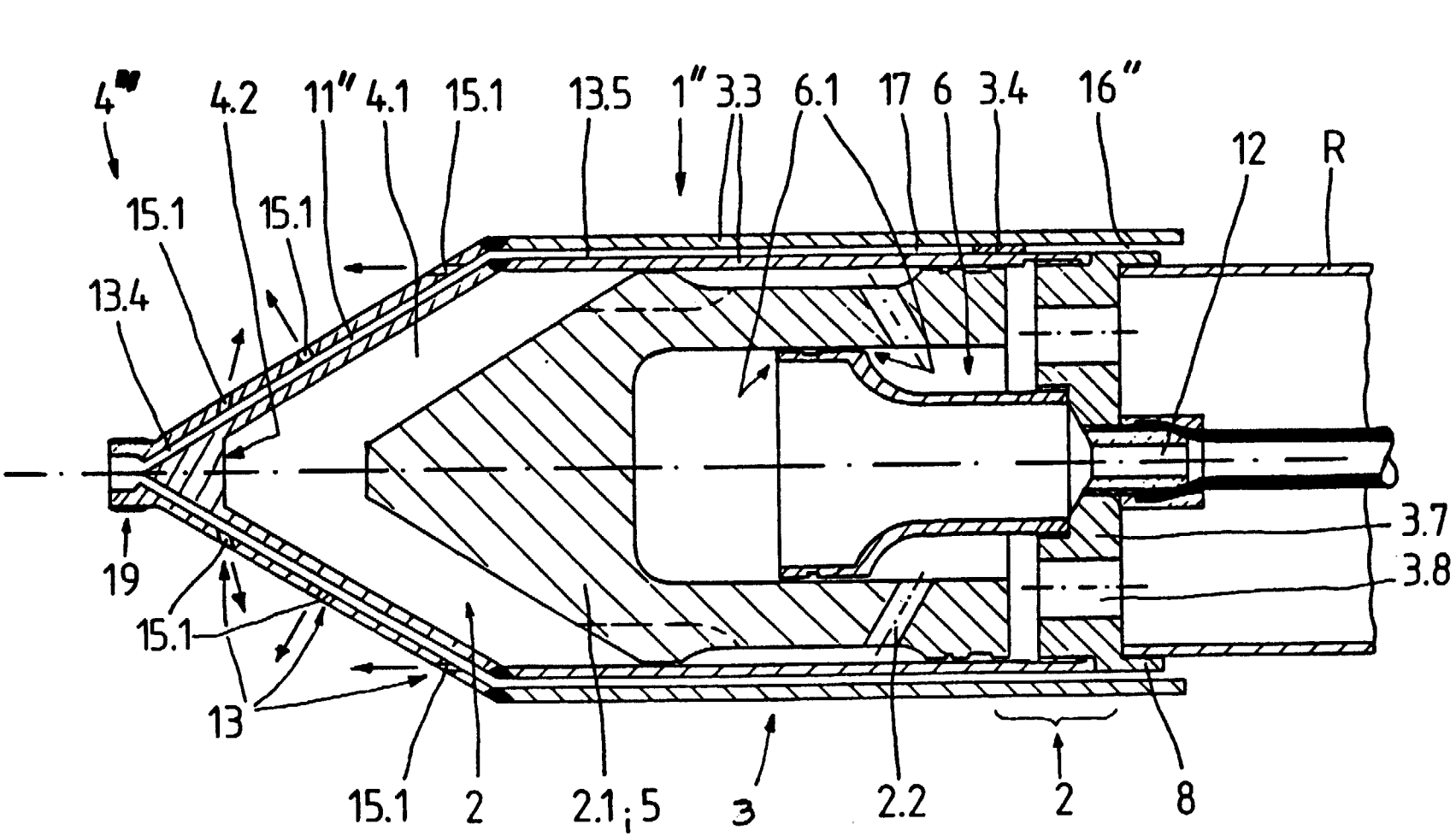
FIG. 5 is a longitudinal sectional view through the pilot hole enlarging apparatus according to a third embodiment of the invention, with a fragmentary view of a tubing section installed.

A second embodiment of the hole enlarging apparatus 1' is shown in FIG. 4, including an internal supply passage 11' for a cutting fluid, receiving fluid from the forward end 19 of the hole enlargement head 4', directing fluid to the fluid jet cutting apparatus 13 integrated in the head 4', as well as supplying fluid for one or a plurality of lubricating nozzles 16 aiding in the insertion of tubing sections R (FIG. 5). This supply passage 11' is thus provided with means for connection to an apparatus which is disposed forward of the hole enlargement head 4', as for instance a pilot hole boring apparatus or an external device. A second supply passage 12 is adapted for connection to the ram control device 6 and to the outside pressurized air source for the hole enlargement device, the second supply passage 12 disposed at the rearward portion of the hole enlargement apparatus 1'.

In accordance with a third embodiment of the hole enlarging apparatus 1'', the housing is comprised of dual pipe sections 3.3 suitably connected, preferably welded, to the hole enlargement head 4''. This dual pipe construction, creates an annular nozzle 16'' for the lubricant. The two tubular members are arranged in spaced apart relationship by the use of spacers 3.4 spaced at suitable intervals.

Figure 6:
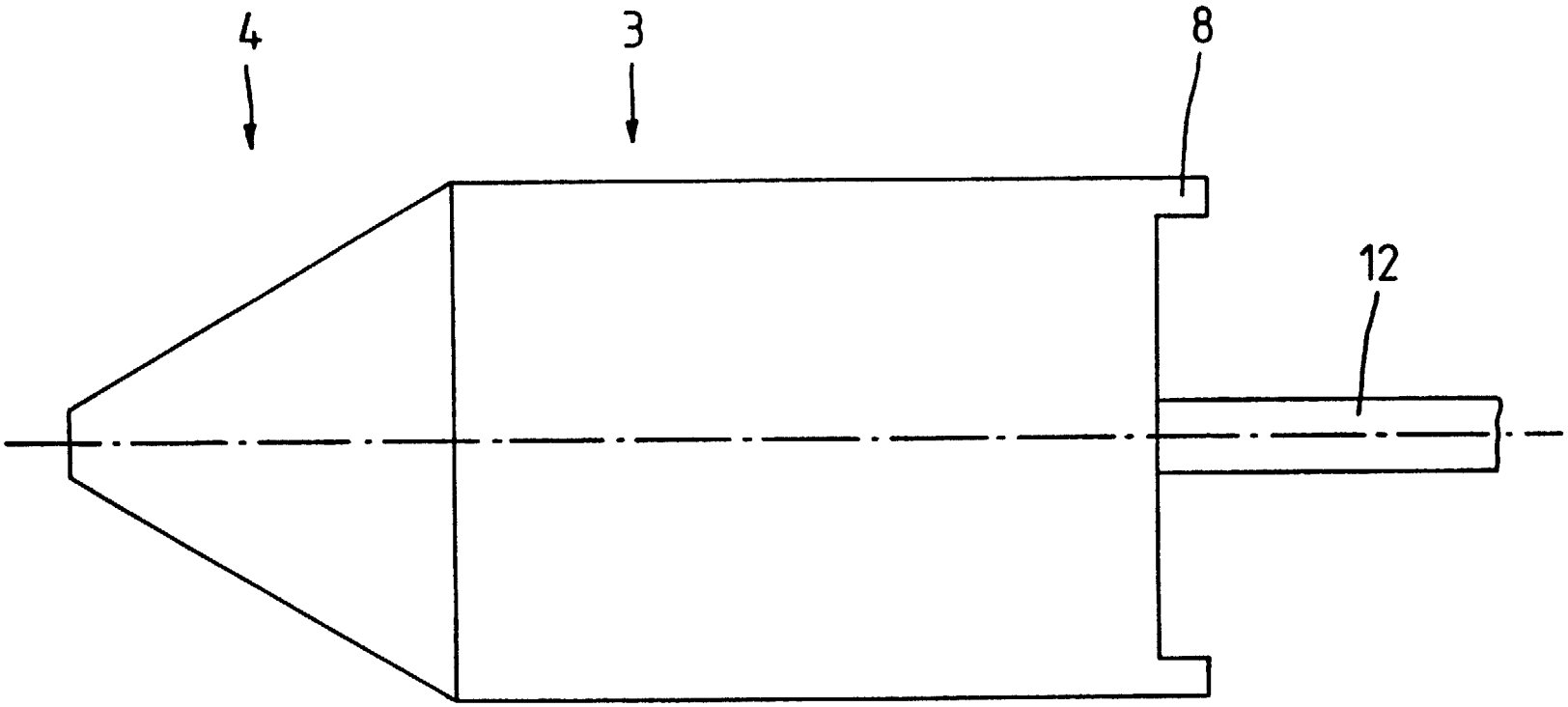
FIG. 6 is an enlarged view of an outer cylindrical form of a housing of the enlarging apparatus according to the present invention.

In accordance with a first form of the outer construction of a housing, the housing 3 is in the form of a cylinder as shown in FIG. 6.

Figure 7:
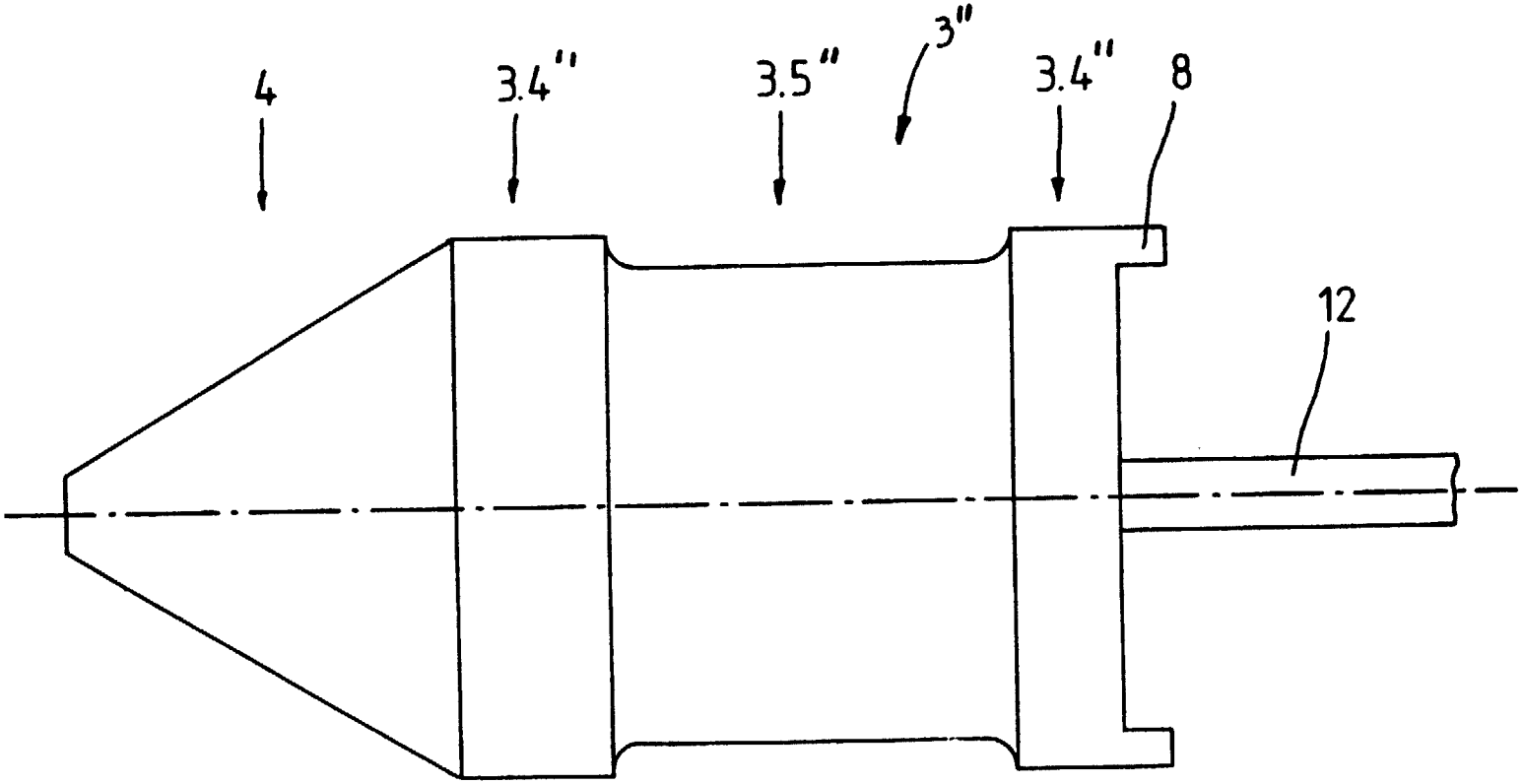
FIG. 7 is an enlarged view of an outer reduced mid-section form of a housing of the enlarging apparatus according to the present invention.

In a second form of the housing 3'', the housing 3'' as shown in FIG. 7, which is generally cylindrical but has a mid-portion with a reduced cross-sectional area the arrangement being such that guide lands 3.4'' are arranged on both ends and a waist portion 3.5'' is provided therebetween for better maneuverability in curves when enlarging an arcuate pilot hole.

Figure 8:
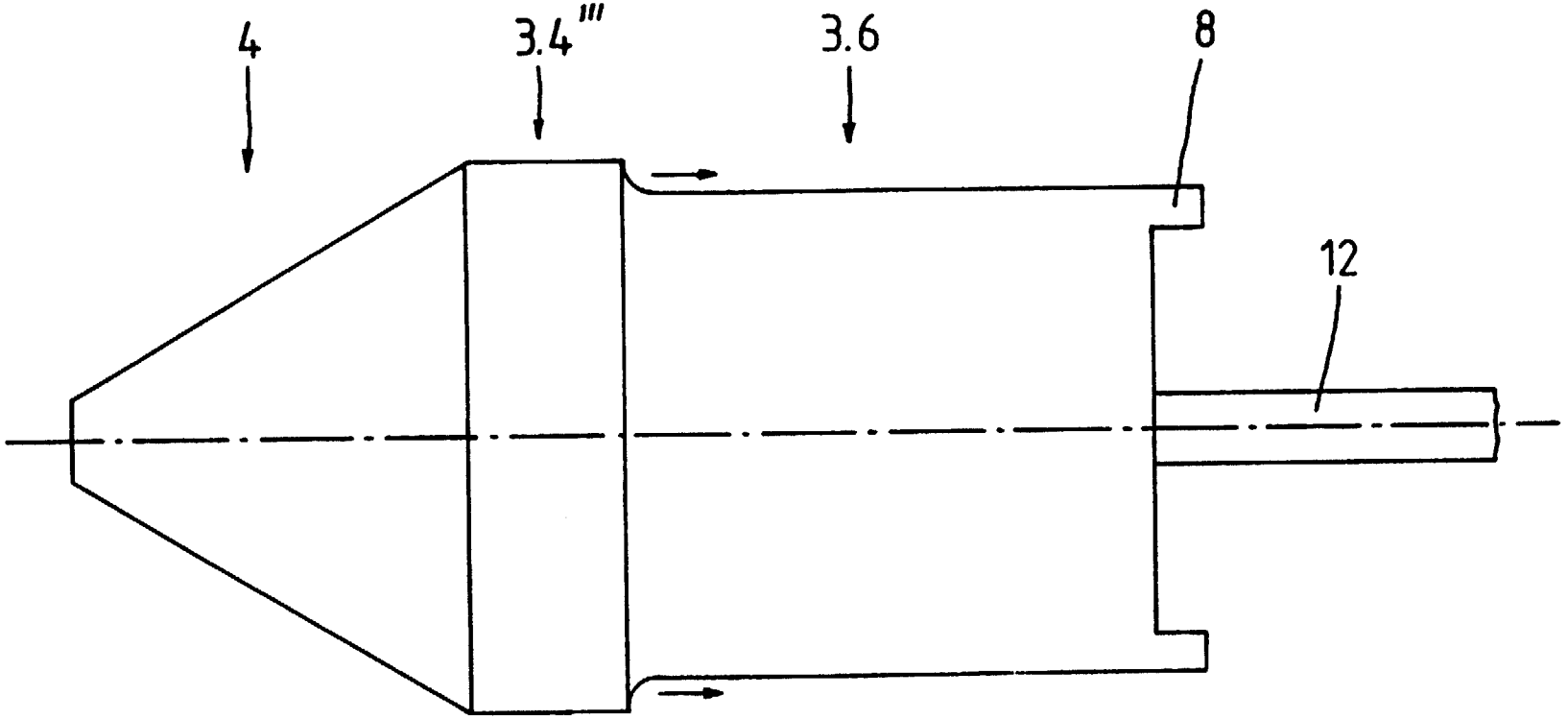
FIG. 8 is an enlarged view of an outer reduced end portion form of a housing of the enlarging apparatus according to the present invention.

A third form of the housing 3''' is shown in FIG. 8, which is generally cylindrical, but has a reduced end portion, the arrangement being such that a guide collar 3.4''' is arranged at the forward end of the housing and the succeeding portion 3.6 has a reduced cross-sectional area which again facilitates the operation of the apparatus in curves.

Figure 3:
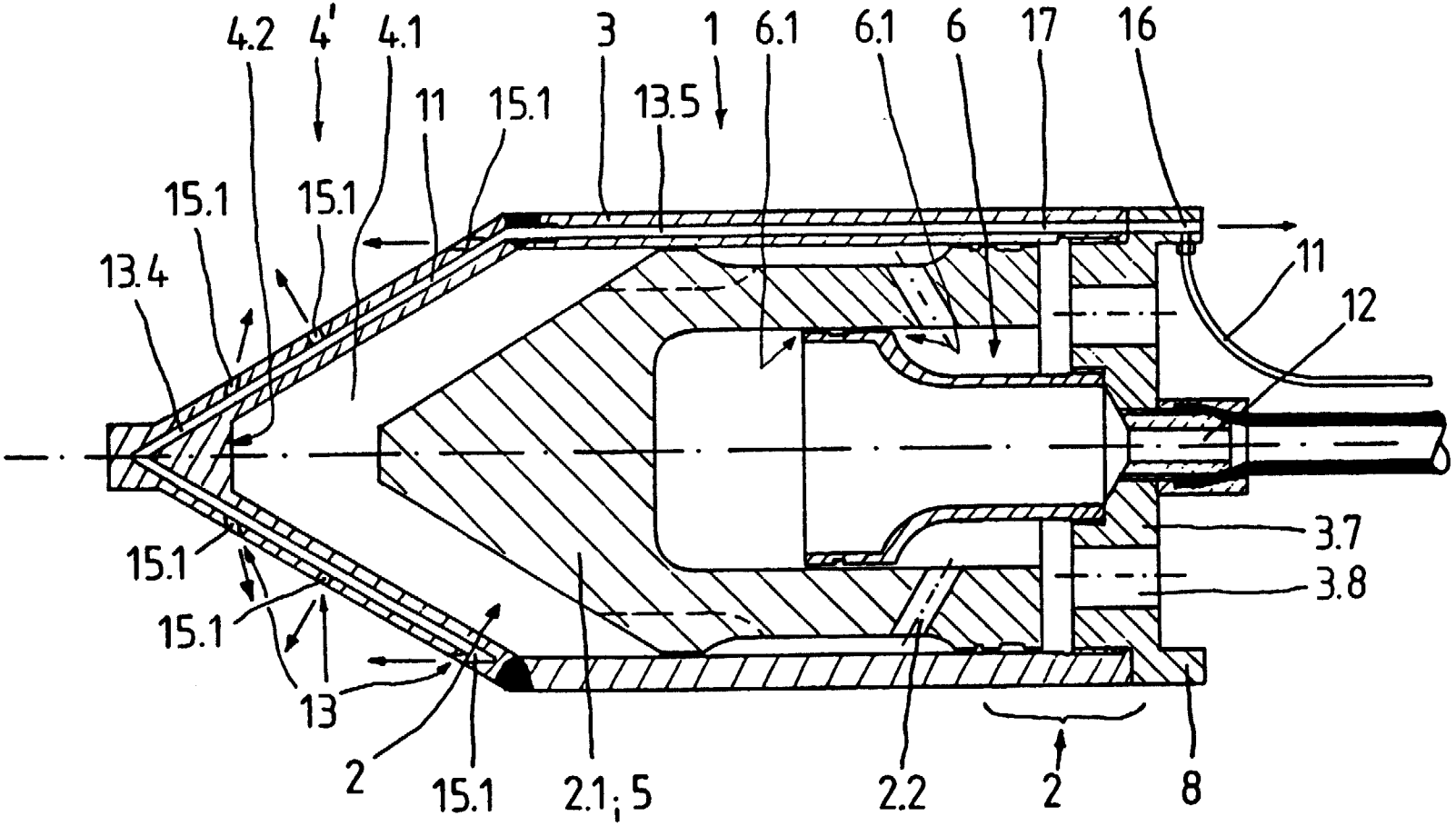
FIG. 3 is a longitudinal sectional view through the pilot hole enlarging apparatus according to a first embodiment of the invention.

The hole enlarging head 4 is in the form of a hollow body 4.1 conically shaped so that a portion of the striking piston 2.1 can be accommodated therein, and it is fixed, preferably by welding, to the housing 3 of the striking means 2, with the joint or, as the case may be, the weld seam being located rearwardly of the place of impact 4.2 of the striking body 5, the place of impact being disposed at the end face. In this arrangement of accommodating a part of the striking piston 2.1, a conical portion of the striking piston 2.1 extends into the hollow head (FIGS. 3–5).

Figure 10:
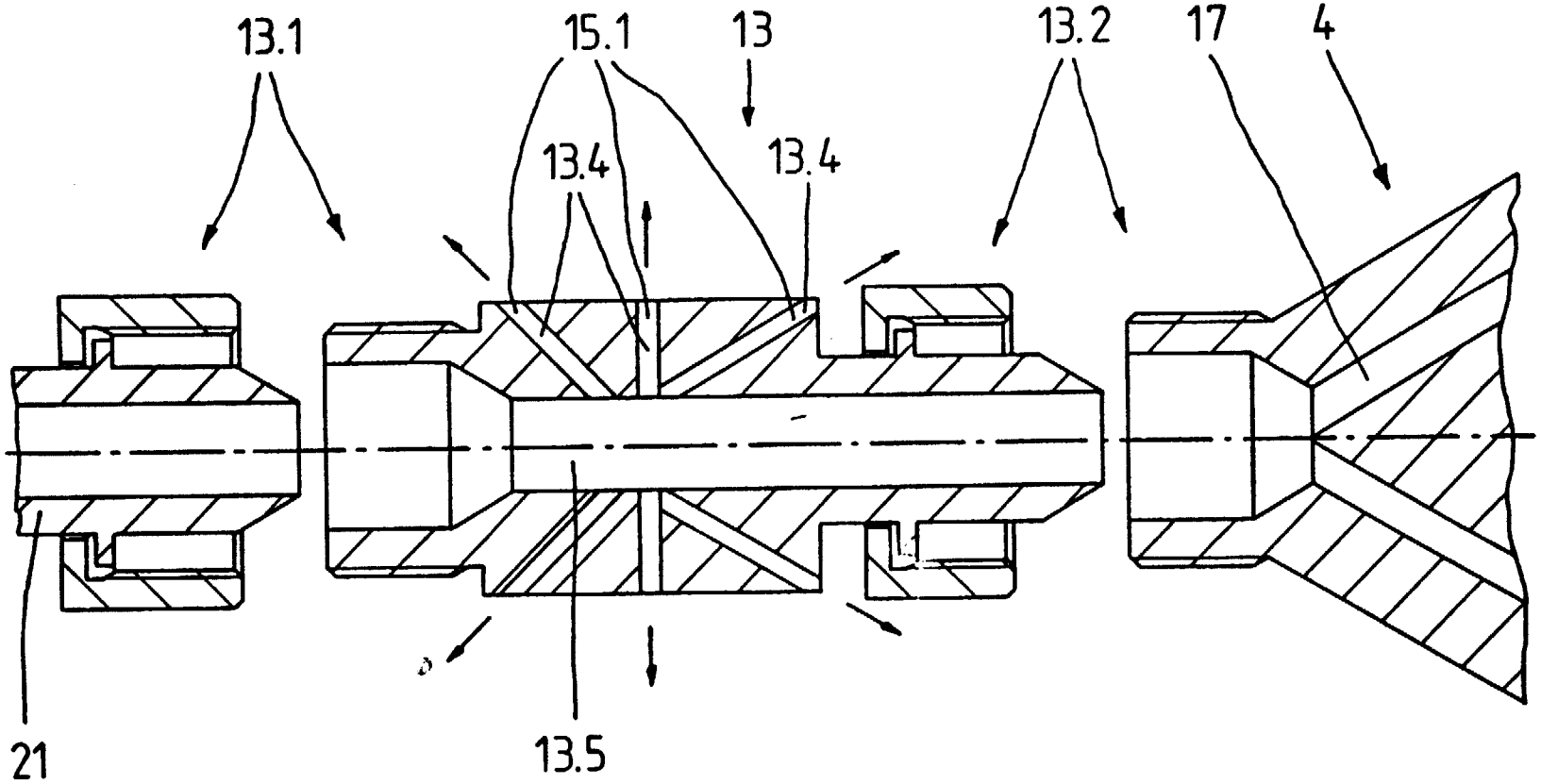
FIG. 10 is a longitudinal sectional view through an external fluid jet cutting device used with the present invention.

The cutting device 13 may be a separate unit (FIG. 10), arranged forwardly of the hole enlarging head 4 and connected thereto, preferably by a pipe thread connection.

The cutting device 13 is provided midway between forwardly and rearwardly disposed coupling means 13.1 and 13.2, respectively, especially coupling means such as suitable fittings 13.1.1 and 13.2.1 employing threaded coupling nuts, with a cutting portion 13.3. The cutting device 13 itself is provided in the region of its outer surface area with fluid jet means 15 which are arranged so as to point in a suitable direction. The fluid jet means 15 are adapted to discharge cutting fluid under high pressure and are oriented so as to point, preferably, in generally forward, rearward and radial directions. The fluid jet means 15 are fitted to fluid conducting passages 13.4 which communicate with a central supply passage 13.5

The central supply passage 13.5 is connected, by means of the threaded pipe fittings 13.1.1 and 13.2.1 to external cutting fluid circuits, as for instance those of a pilot hole bore apparatus 14 or a hole enlarging apparatus 1. The hole enlargement apparatus may also be fitted to the pilot hole bore apparatus 14 by means of the cutting device 13.

The cutting device 13 may also be an integral part of the hole enlarging head 4, as shown in FIGS. 3–5. The cutting device 13 is provided with internal passage means 13.4 for conducting the cutting fluid to means arranged in the head 4 for effecting the discharge of the cutting fluid under high pressure, with the fluid passage means being connected to corresponding conduits of a supply network in the cylindrical housing 3.

In both cases, the fluid jet means 15 of the cutting device 13 for the discharge of cutting fluid under high pressure include nozzle openings 15.1 which receive nozzle insert members (not shown), adapted for insertion at the free ends of the internal flow passages 13.4 of the cutting device 13. Such nozzle inserts are typically made of industrial jewels.

The axial orientation of at least some of the nozzle-like openings is at least partially in the direction of advance, that is, with a forwardly oriented direction component. However, it is also possible to orient the axes of a few of the nozzle openings 15.1 at least partially in the direction opposite of the advance direction of the bore hole, that is, with a rearwardly oriented direction component as shown in FIGS. 3–5.

At the rearward end there is disposed at least one lubricating nozzle 16 for the discharge of cutting fluid to the wall side of the tubular section that is being drawn in by the hole enlargement device 1 so as to provide lubrication for the inward movement of the tubular section R. The lubricating fluid is part of the cutting fluid and is admitted from the supply line 11, 11', 11" through a lubricating passage 17 which leads to the lubricating nozzle 16. The lubricating nozzle may also be in the form of an annular nozzle 16" and may extend, for all practical purposes, over the entire circumference of the rearward end of the housing (FIG. 5).

Figure 9:
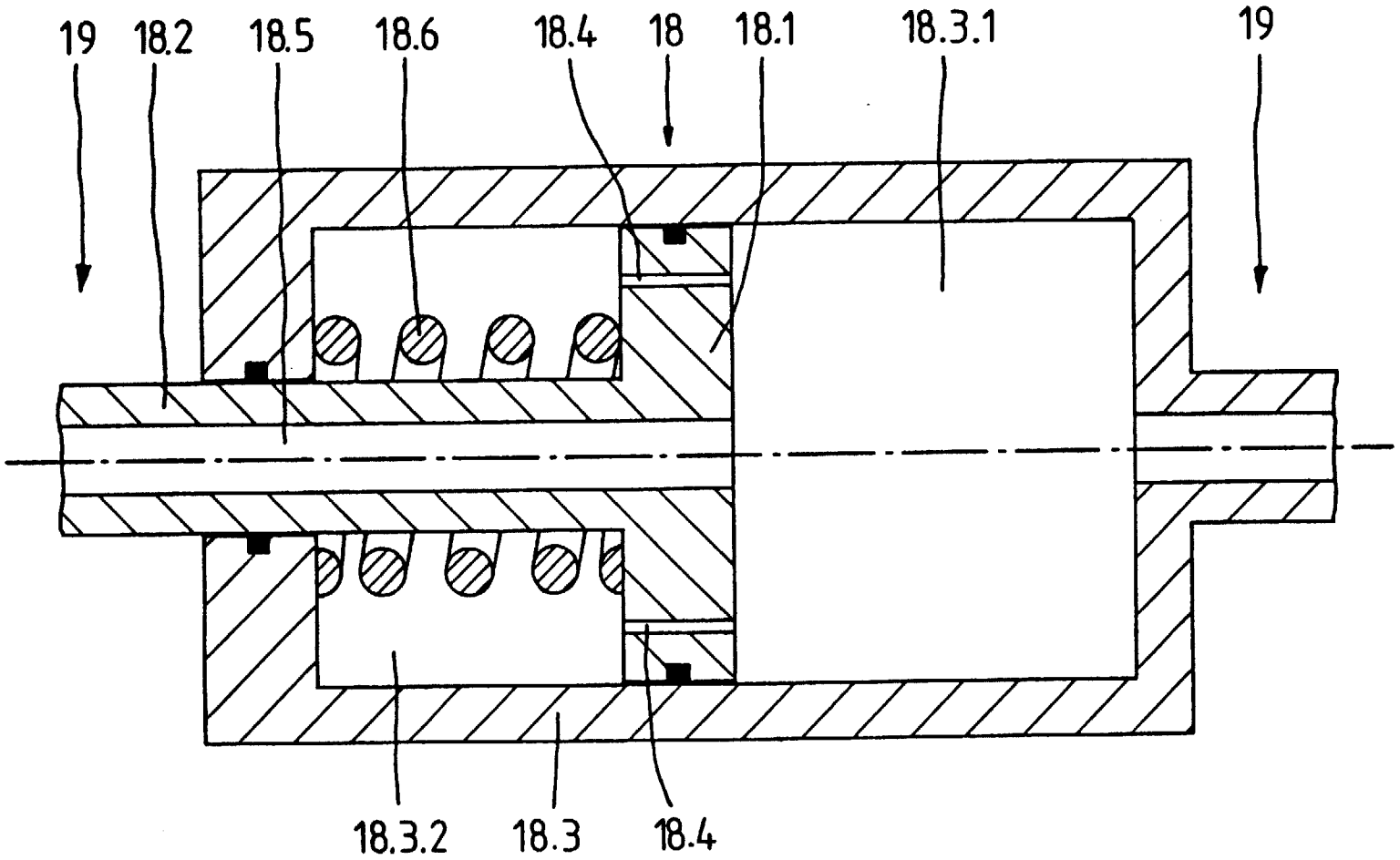
FIG. 9 is a sectional view of a damping unit used to couple the hole enlarging apparatus according to the invention with the pilot hole boring device.

The hole enlarging device may be interconnected to a pilot boring device 14 by the interpositioning of a damping element 18 shown in FIG. 9. The pilot boring device may be a static pilot boring apparatus 14 of the conventional type and may be comprised of a tubular rod 21 as well as a displacement head 20 with integrated high-pressure nozzles which are connected at one end to the tubular rod 21 and at the other end to a supply and pressure producing device (not illustrated) which serves to deliver the static pressure required for the forward movement of the pilot boring device in the ground. The enlarging head 4 is also connected to the cutting fluid supply conduit of the pilot boring apparatus 14.

Preferably, the damping element 18 is a hydraulically acting damping member. Its use is required when the hole enlarging device is coupled to a pilot boring device when the same is on its return phase, and it is comprised of a cylinder 18.3 which is adapted for connection, as for instance by means of a threaded pipe coupling 19, to the hole enlarging apparatus 1, and which contains a piston 18.1. The piston 18.1 as well as the associated piston rod 18.2, are provided with respective central bores 18.5. The piston rod, too, is adapted for connection to a pilot boring apparatus 14 by means of threaded pipe fittings 19. A compression spring 18.6 is inserted between the piston 18.1 and cylinder 18.3. Furthermore, connecting passages 18.4 are provided in the piston 18.1 for connecting the two chambers 18.3.1, 18.3.2. The connecting passages 18.4 serve as damping bores in that the cutting fluid contained in the cylinder 18.3 is being forced, with every strike of the ramming hole enlargement apparatus 1, from one chamber into the other chamber while cushioning the strike of the hole enlarging device.

By providing a cushioning element 18 of this type, a constant pressure is exerted by the pilot boring device 14 upon the piston rod 18.2 which is in its withdrawal phase from the pilot bore 10. A cushioning device of this type is necessary to prevent the strikes of the short ram from being transmitted to the pilot boring device 14 and to protect the same against damage.

The components and the modified embodiments of the same enable a variety of hole enlarging devices to be made, especially the following types:

In a hole enlargement apparatus 1 of the type shown in FIG. 3, a housing with an inner construction of the first embodiment is provided. That housing contains a striking means 2 as described above which has its second line network connected to the pressurized air lines of the supply system of the hole enlarging apparatus 1. The tip of the head of the hole enlarging apparatus 1 is coupled to a cutting device 13 that receives its cutting fluid supply from the supply source of the hole enlarging apparatus 1 through the housing.

In a hole enlargement apparatus 1' of the type shown in FIG. 4, a housing in accordance with the second embodiment of the inner construction is provided which contains a striking means 2 as described above. That striking means 2 has a supply connected to the compressed air lines of the supply source of the hole enlarging apparatus. The supply is connected a coupling 19 at via the tip of the head of the hole enlargement device 1 to a cushioning element 18, and this, in turn, is connected to a pilot boring rod section of a pilot hole boring apparatus 14 which is also used to supply the cuttinq fluid.

In a hole enlargement apparatus 1" of the type shown in FIG. 5, a housing 3 embodying the third modification of the inner construction is provided. That housing 3 includes a striking means 2 of the type described above having a fluid connection to the pressurized air conduits of the supply system of the hole enlargement apparatus 1". The housing is coupled, via a coupling 19 at the tip of the head of the hole enlarging apparatus, to a cushioning element 18 and this, in turn, to the tubing of a pilot boring device 14 which also serves to supply the cutting fluid.

In the method according to the invention, the hole enlarging apparatus 1 forces its way, solely by its own ramming and cutting action, into an existing pilot bore hole 10 and, as the surrounding soil is being displaced by the housing 3, enlarges the pilot bore hole 10 since its diameter is larger than that of the pilot bore hole 10.

In a variation of the method according to the invention, the hole enlarging apparatus is coupled at its tip to a pilot boring device 14 by means of a cushioning element 18, and penetrates by its ramming action, into a pilot bore hole 10 between two excavations. During this process, the pilot hole boring device 14, which is being withdrawn from the pilot bore hole 10, exerts an additional pull on the hole enlarging device 1 of approximately 5 tons. Because of the larger diameter of the hole enlarging apparatus 1 relative to the pilot bore hole 10, the pilot bore hole 10 is being enlarged.

Since the tubular section R to be drawn inwardly can be coupled to the ramming-type hole enlarging device, it not only will be drawn into the hole in the same operational step used for the hole enlargement procedure, but due to the jerk-like movements to which is subjected, the tubing R can be drawn into the hole with less effort and thus over a larger distance than is possible with the conventional method, especially with enlarging methods in which a static pull alone is being employed.

The ability to combine two operations into one and to cover larger distances saves a considerable amount of time as well as equipment and labor. Therefore, the pipe insertion operation becomes less expensive in comparison to methods and equipment employed in the past.

The combination of ramming and cutting action on the earth mass substantially increases the propulsion efficiency and it also enables working very hard ground or ground with rock inclusions, which, with the conventional static methods (pushing and pulling), could not be accomplished at all or could be accomplished only at relatively high costs. Therefore, the method according to the invention not only constitutes a gain in terms of efficiency and economy, but it also enlarges the field of application.

The hole enlarging apparatus in the form of a short ram is able, by virtue of its short construction as compared to conventional ram-type boring devices, to follow curves in an arcuate pilot hole without difficulties.

Its percussive or striking action enables disintegration or displacement of relatively large rock inclusions adjacent to pilot bore holes. Especially the embodiments featuring the housings reduced diameter mid-portion or reduced diameter end portion will enable the device to follow curves, even curves with relatively short diameters.

The cutting and ramming-type hole enlarging device, in any of its modifications, as the one with integral cutting device, forwardly mounted cutting device, supply only from the rear, supply from the front and the rear, annular nozzle used as lubricating nozzle, individual lubricating nozzles, etc., is operated by the compressed air supply system of the hole enlargement apparatus like an earth ramming machine adapted to run only in one direction, and is running on a cadence that can be preset by way of the control geometry of the control valving associated with the striking means.

Simultaneously with the ramming movement, the hole enlargement apparatus is supplied with cutting fluid by one or the other supply system, depending on the mode of operation (the supply system for the pilot hole bore device or the supply system for the hole enlarging device itself). The cutting fluid is forced under extremely high pressure through the cutting fluid nozzles and into the ground whereby the ground is being cut. This will also enable cutting through rock inclusions which can then be crushed by the succeeding percussive motion of the ramming activity. Since lubrication is provided to the tubing to be inserted, most of the energy is being used for the advance instead of for the insertion of the tubing, even in cases where the tubular sections are relatively long. Thus even relatively long tubular sections can be inserted more economically. This cuts down on rigging work in that less excavating work is required for the individual sections and this renders possible the use of longer rod sections. Furthermore, the risk that the large frictional forces acting on the wall surrounded by the earth masses cannot be overcome when only static pull or thrust forces are being supplied, has been eliminated.

I claim:

1. A method of forming a bore hole in the earth by enlarging a pilot bore hole to an increased diameter, comprising the steps of:

forming a pilot bore hole in the earth;

advancing a body of larger diameter than said pilot bore holes through said pilot bore hole while cyclically striking said body with a mass rammed to impact said body along a direction aligned with said pilot bore hole, simultaneously subjecting the earth ahead of said body to a cutting action by directing high pressure cutting jets ahead of said body and causing displacement of the surrounding earth by advance of said body through said pilot bore hole while exerting a steady pull on said body as said body is advanced through said pilot bore hole.

2. The method according to claim 1, wherein said step of subjecting the earth ahead of said body to a cutting action further includes the step of directing high pressure fluid cutting jets forwardly and outwardly of said body and into the earth surrounding said body.

3. The method according to claim 2, wherein said step of subjecting the earth ahead of said body to a cutting action further including the step of directing high-pressure fluid cutting jets radially outwardly from said body.

4. The method according to claim 1, further including the step of directing a portion of the fluid supplied for said high pressure fluid cutting jets rearwardly of said body for reducing the friction between the wall of said pilot bore hole and said body.

5. A bore hold enlarging apparatus for enlarging a pilot bore hole formed in the earth, including a housing with a forwardly disposed enlarging head of larger diameter than said pilot bore hole, and drive means for advancing said housing in an advancing direction along said pilot bore hole and through the earth surrounding said pilot bore hole, said drive means comprising striking means causing an incremental forward movement of said housing, said enlarging head mounted to the forward end of said housing by a circumferential weld seam and having an inner end face located forwardly of said weld seam, said striking means including a striking member mounted within said housing and having a portion adapted for striking said inner end face on said enlarging head, and means for cyclically ramming said striking member against said inner end face, said housing forming a cylinder of a predetermined diameter and having a length less than four times said diameter of said housing, said enlarging head being formed with a hollow interior space defined in part by said inner end face and adapted to receive said portion of said striking member, a cutting device including means for discharging high-pressure fluid cutting jets into the earth adjacent said enlarging head; and coupling means at the forward end of said enlarging head adapted to connect other equipment, said coupling means having conduits for high-pressure cutting fluid.

6. A bore hole enlarging apparatus according to claim 5, wherein said means for discharging high pressure fluid cutting jets comprises nozzle openings in said enlarging head.

7. A bore hole enlarging apparatus according to claim 6 wherein said cutting device is mounted forwardly of said enlarging head and is connected thereto.

8. A bore hole enlarging apparatus according to claim 6, wherein said apparatus cutting device is mounted within said enlarging head and is connected thereto.

9. A bore hole enlarging apparatus according to claim 8, wherein said enlarging head has a plurality of nozzle openings directing fluid cutting jets, each having an axial center line, and wherein said axial center line of each nozzle opening is oriented at least partially in the advancing direction of said body.

10. A bore hole enlarging apparatus according to claim 9, wherein said axial center line of each nozzle opening is oriented at least partially in the direction opposite to the advancing direction of said body.

11. A bore hole enlarging apparatus according to claim 10, wherein said axial center line of nozzle openings are oriented in part approximately oppositely to the advancing direction of said body, as well as in part radially to said pilot bore hole.

12. A bore hole enlarging apparatus according to claim 5, wherein at least one lubricating fitting is arranged at a rearward end of said housing and means are included for directing a discharge of cutting fluid therethrough so as to provide lubrication.

13. A bore hole enlarging apparatus according to claim 5, wherein said housing has an intermediate waist-like portion of reduced diameter than portions at either end of said body to facilitate movement of said body along curving pilot bore holes.

14. A bore hole enlarging apparatus according to claim 13, further including supply conduits connected to said housing.

15. The bore hole enlarging apparatus according to claim 6 wherein said nozzle openings are formed by jewel inserts.

16. A bore hole enlarging apparatus for enlarging a pilot bore hole formed in the earth, including a housing with a forwardly disposed enlarging head of larger diameter than said pilot bore hole, and drive means for advancing said housing in an advancing direction along said pilot bore hole and through the earth surrounding said pilot bore hole, said drive means comprising striking means causing an incremental forward movement of said housing, said enlarging head mounted to the forward end of said housing by a circumferential weld and having an inner end face located forwardly of said weld seam, said striking means including a striking member mounted within said housing and having a portion adapted for striking said inner end face on said enlarging head, and means for cyclically ramming said striking member against said inner end face, said housing forming a cylinder of a predetermined diameter and having a length less than four times said diameter of said housing, said enlarging head being formed with a hollow interior space defined in part by said inner end face and adapted to receive said portion of said striking member, a cutting device including means for discharging high-pressure fluid cutting jets into the earth adjacent said enlarging head; and a pilot hole boring device connected to said housing and a cushioning element interposed between said housing and said pilot hole boring device.

* * * * *